US005363983A

United States Patent [19]

Proshan

[11] Patent Number: 5,363,983

[45] Date of Patent: Nov. 15, 1994

[54] DETACHABLE CAP FOR DISPOSABLE CONTAINERS OF LIQUID

[76] Inventor: Mary-Elizabeth Proshan, Suite 194, 301 N. Harrison St., Princeton, N.J. 08540

[21] Appl. No.: 224,158

[22] Filed: Apr. 7, 1994

[51] Int. Cl.[5] ..... A47G 19/22

[52] U.S. Cl. ..... 220/717; 220/713; 220/306; 220/380

[58] Field of Search ..... 220/705, 713, 717, 718, 220/380, 306; 222/566, 570, 571, 574

[56] References Cited

U.S. PATENT DOCUMENTS

| | | | |
|---|---|---|---|
| D. 233,972 | 12/1974 | Juhlin | 220/713 X |
| 4,243,156 | 1/1981 | Lobbestael | 222/541 |
| 4,303,170 | 12/1981 | Panicci | 220/717 X |
| 4,828,141 | 5/1989 | Coy | 220/380 |
| 4,850,496 | 7/1989 | Rudell et al. | 215/12.1 |
| 4,946,062 | 8/1990 | Coy | 220/380 X |
| 4,953,737 | 9/1990 | Meyers | 220/717 X |
| 4,961,510 | 10/1990 | Dvoracek | 220/713 |
| 5,147,066 | 9/1992 | Snider | 220/717 |

*Primary Examiner*—Gary E. Elkins
*Assistant Examiner*—Stephen Cronin

[57] ABSTRACT

A cap for detachably enclosing an upper open end of a hollow vertical disposable container with liquid therein employs a flat horizontal disc having first and second openings disposed in spaced apart positions therein. The first opening is a pin hole. The second opening is relatively large. The disc has a peripheral socket adapted to engage the periphery of the upper end of the container in such manner that liquid cannot flow out. A hollow vertical hollow spout tapers upwardly from the disc with an open lower end coincident with the second opening. An open upper of the spout is smaller in area than its lower end. A member is disposed within the spout with an upper open end coincident with the upper end of the spout and extends downwardly and inwardly from the upper end of the spout. A lower end of the spout has at least one hole therein. The lower end of the member is disposed intermediate the upper and lower ends of the spout:

the disc, spout and member constituting a single integral unit which when positioned in place on the container will not exhibit any substantial leakage of liquid when the liquid in the container surges therein because of sudden movement of the container or when the container is disposed horizontally on its side:

8 Claims, 2 Drawing Sheets

DETACHABLE CAP FOR DISPOSABLE CONTAINERS OF LIQUID

CROSS REFERENCE TO COPENDING APPLICATION

The present application is related to copending application entitled, REMOVABLE CAP FOR DISPOSABLE CONTAINERS OF LIQUID filed on even date herewith, Ser. No. 08/224,159. Both applications identify the same inventor and are owned in common.

BACKGROUND OF THE INVENTION

Disposable containers containing cold or hot liquids are in wide use. In order to prevent the liquid from being accidently spilled during use, it is known to cover the open upper end of the container with a disposable cap having an upwardly extending drinking spout. The cap has a peripheral socket which engages the periphery of the upper end of the container.

Known caps when secured to such containers are subject to substantial and undesired leakage when a container of liquid covered with a known cap is disposed horizontally on its side or even when the container is disposed vertically and is subjected to sudden movement as for example when held in a moving vehicle so that the liquid surges upward and out ot the spout.

The present invention is directed toward a new type of disposable cap which eliminates such liquid leakage problems.

SUMMARY OF THE INVENTION

Accordingly, it is an object of the present invention to provide a new and improved disposable cap for disposable containers of liquid wherein when said cap is secured to the open end of the container will not exhibit any appreciable leakage when the container is disposed horizontally on its side or when the container is disposed vertically and is subjected to sudden movement.

Another object is to provide a new and improved disposable caps of the character indicated which can be easily and inexpensively vacuum molded.

Yet another object is to provide new and improved disposable caps of the character indicated which can be easily stacked one above the other.

These and other objects and advantages of the invention will either be explained or will become apparent hereinafter.

In accordance with the principles of this invention, a cap detachably enclosing an upper open end of a hollow vertical disposable container with liquid therein takes the form of a flat horizontal disc having first and second openings disposed in spaced apart positions therein. The first opening is a pin hole and the second opening is relatively large. The disc has a peripheral socket adapted to engage the periphery of the upper end of the container in such manner that liquid cannot flow out therebetween.

A hollow vertical hollow spout is employed for delivery of the liquid. said spout The spout tapers upwardly from the disc and has an open lower end coincident with the second opening. The spout has an open upper end, the upper end being smaller in area than the lower end.

A member disposed within the spout has an upper open end coincident with the upper end of the spout and extends downwardly and inwardly from the upper end of the spout. The member has a tower end with at least one hole therein, the lower end of the member being disposed intermediate the upper and lower ends of the spout.

The disc, spout and member constitute a single integral unit which when positioned in place on the container will not exhibit any substantial leakage of liquid when the liquid in the container surges therein because of sudden movement of the container or when the container is disposed horizontally on its side. More particularly, only a drop or so of liquid may leak out.

The lower end of the member must be disposed between the upper and lower ends of the spout to permit one cap to be stacked above another with the spout of the lower cap extending partially within the spout of the upper cap. If the lower end of the member engages or is closely disposed adjacent the lower end of the spout, this stacking cannot take place. The caps must be stackable for ease of transport, packing and dispensing for use. Caps which cannot be stacked are not economically competive with stackable caps.

Caps in accordance with the invention are vacuum molded. The spouts which are vacuum molded must be vertically tapered and the resultant internal angle of taper is such that, unless the lower end of the member is closely spaced from the upper end of the spout, the stacking action is not commercially acceptable.

BRIEF DESCRIPTION OF THE INVENTION

DETAILED DESCRIPTION OF PREFERRED EMBODIMENT

Figure 1:
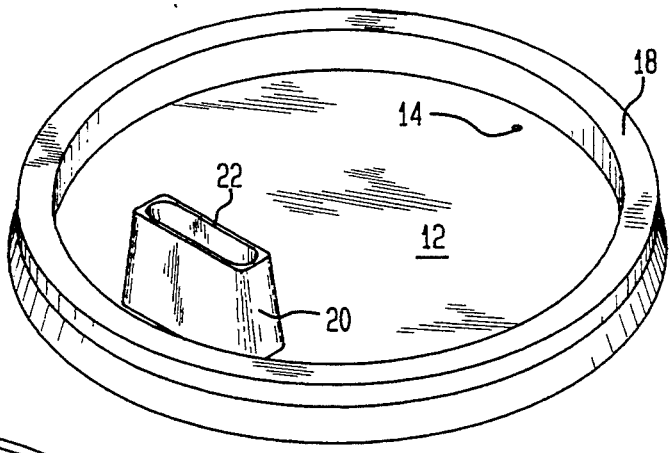
FIG. 1 is a top perspective view of a preferred embodiment of the invention.
Figure 2:
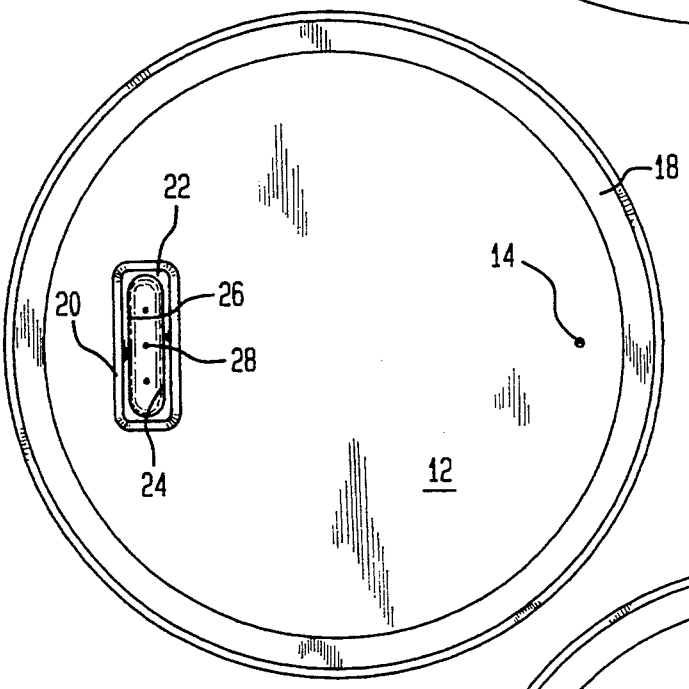
FIG. 2 is a top plan view thereof.
Figure 3:
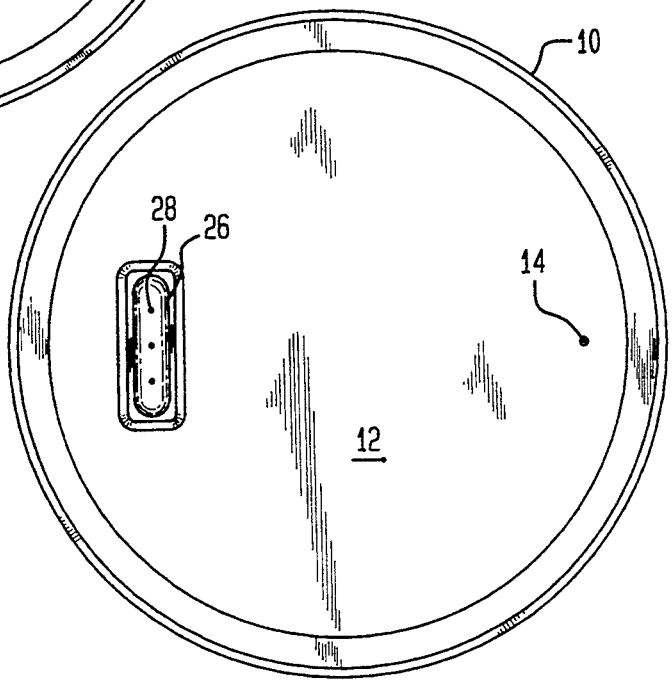
FIG. 3 is a bottom plan view thereof.
Figure 4:
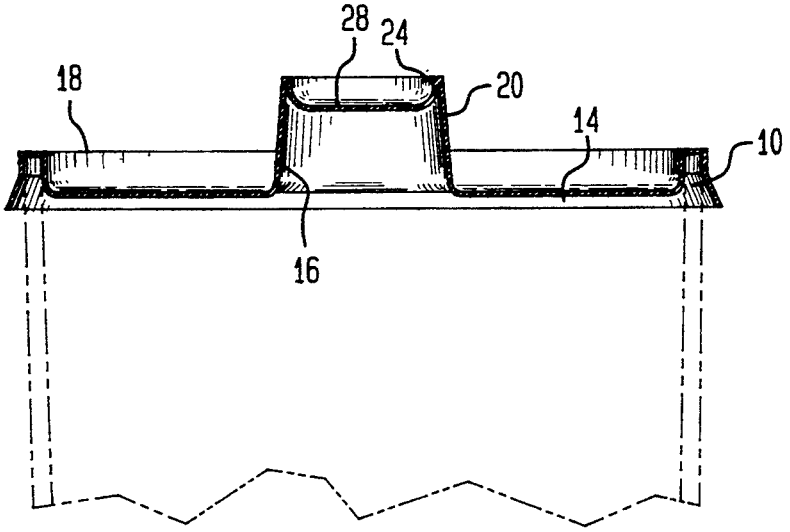
FIG. 4 is a vertical cross sectional view thereof as taken at right angles to the width of the spout.
Figure 5:
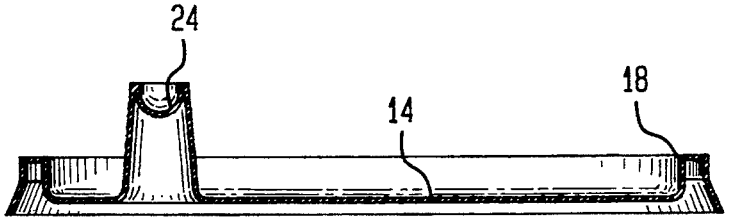
FIG. 5 is a vertical cross sectional view thereof as taken at right angles to the cross sectional view shown in FIG. 4.

Referring now to FIGS. 1–5, there is shown a cap for detachably enclosing an upper open end 10 of a hollow vertical disposable container with liquid therein. The container has a closed lower end.

The cap employs a flat horizontal disc 12 having first and second openings 14 and 16 disposed in spaced apart positions therein. The first opening 14 is a pin hole and is used to establish a path for air to escape when the cap is positioned on a container filled with liquid as well as enabling air to enter the container as the liquid is consumed and its level is reduced. The second opening 16 is relatively large and is rectangular in shape.

The disc has a peripheral socket 18 adapted to engage the periphery of the upper end of the container so tightly that liquid cannot flow out therebetween.

A hollow vertical hollow spout 20 for delivery of the liquid tapers upwardly from the disc. The spout has an open lower end coincident with said second opening 16. The spout has an open upper end 22, the opening being smaller in area than the lower end.

A member 24 is disposed within the spout with an upper open end coincident with the upper end of the spout. The member extends downwardly and inwardly from the upper end of the spout. The member has a lower end 26 with at least one hole 28 therein, the lower end of the member being disposed intermediate the upper and lower ends of the spout: As shown, there are two holes 28 of like circular shape which are disposed side by side and extend along the long dimension of the openings in the spout.

The disc, spout and member constitute a single integral unit which when positioned in place on the container will not exhibit any substantial leakage of liquid when the liquid in the container surges therein because of sudden movement of the container or when the container is disposed horizontally on its side. More particularly, the leakage is limited to one or two drops of liquid.

The lower end of the member is disposed close to the upper end of the spout and remote from the lower end of the spout. The member is upwardly curved as a result of the vacuum forming process. As explained previously, if the member is disposed too closely to the lower end of the spout, the stacking operation shown in FIG. 6 cannot be carried out satisfactorily.

The material used in vacuum forming, typically polyethylene, is to be as thin as commercially practicable. As a result, the lower end of the member becomes very thin as the member is moved downwardly in the spout and if this lower end of the member becomes too thin, the member will not function properly in limiting liquid leakage as explained above. The circular holes provide better structural strength than would be provided by a single rectangular slit.

Figure 6:
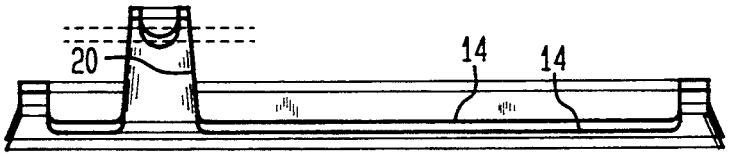
FIG. 6 is a view showing two caps in accordance with the preferred embodiment of the invention which are removably stacked together.

As shown in FIG. 6, when two or more caps are stacked, the spout of the lower cap penetrates the spout of the upper cap to a sufficient extent to provide acceptable stacking.

Illustrative dimensions of the preferred embodiment are as follows.

The inner diameter of the disc which extends to the inner edge of the socket is 3 and $\frac{1}{4}$ inches, while the diameter which extends to the outer edge of the socket is 3 and $\frac{3}{8}$ inches.

The spout is $\frac{3}{8}$ inches high as measured from the plane of the disc, is 13/16 inches long and $\frac{1}{4}$ inch wide as measured at its top, and is 15/16 inches long and $\frac{3}{8}$ inches wide as measured at its bottom.

The inner side of the socket has a maximum height of 3/16 inches above the disc and the outer side of the socket is 5/16 inches in length and extends 2/16 inches below the disc. The socket is $\frac{1}{8}$ inches thick.

The lower end of the member is disposed $\frac{1}{4}$ inch below the top of the spout. The length of the member is about 11/16 inches. The width of the member is about 3/16 inches. The holes which are equidistantly spaced have like diameters of about 3/32 inches.

The spout is disposed off center in the disc and can have an outer edge coincident with the inner side of the socket if desired.

While the invention has been described with particular reference to the preferred embodiment and the drawings, the protection sought is to be limited only by the terms of the claims which follow.

What is claimed is:

1. A cap for detachably enclosing an upper open end of a hollow vertical disposable container with liquid therein, the container having a closed lower end, said cap comprising:

a flat horizontal disc having first and second openings disposed in spaced apart positions therein, the first opening being a pin hole, the second opening being relatively large, the disc having a peripheral socket adapted to engage the periphery of the upper end of the container in such manner that liquid cannot flow out therebetween;

a hollow vertical hollow spout for delivery of said liquid, said spout tapering upwardly from the disc and having an open lower end coincident with said second opening, the spout having an open upper end, the upper end being smaller in area than the lower end; and a member is disposed within the spout with an upper permanently open end having a constant area and coincident with the upper end of the spout, the member having walls which are immobile with respect to each other and which extend downwardly and inwardly from the upper end of the spout, the member having a lower end with at least one permanently open hole having a constant area therein, the lower end of the member being disposed intermediate the upper and lower ends of the spout;

the disc, spout and member constituting a single integral unit which when positioned in place on the container will not exhibit any substantial leakage of liquid when the liquid in the container surges therein because of sudden movement of the container or when the container is disposed horizontally on its side.

2. The cap of claim 1 wherein the lower end of the member is disposed close to the upper end of the spout and remote from the lower end of the spout.

3. The cap of claim 2 wherein tile single integral unit is vacuum formed.

4. The cap of claim 3 wherein the lower end of the member is upwardly curved.

5. The cap of claim 4 wherein the upper open end of the spout has the shape of a rectangle and the lower end of the member as viewed in a horizontal plane has the shape of a rectangle.

6. The cap of claim 5 wherein the lower end of the member has two spaced holes disposed side by side.

7. The cap of claim 6 wherein the two spaced holes are circular with like diameters.

8. In combination, first and second like caps, each cap being adapted to detachably enclose an upper open end of a hollow vertical disposable container with liquid therein, the container having a closed lower end, each cap comprising:

a flat horizontal disc having first and second openings disposed in spaced apart positions therein, the first opening being a pin hole, the second opening being relatively large, the disc having a peripheral socket adapted to engage the periphery of the upper end of the container in such manner that liquid cannot flow out therebetween;

a hollow vertical hollow spout for delivery of said liquid, said spout tapering upwardly from the disc and having an open lower end coincident with said second opening, the spout having an open upper end, the upper end being smaller in area than the lower end; and a member is disposed within the spout with an upper permanently open end having a constant area and coincident with the upper end of the spout, the member having walls which are immobile with respect to each other and which extend downwardly and inwardly from the upper end of the spout, the member having a lower end with at least one permanently open hole having a constant area therein, the lower end of the member being disposed intermediate the upper and lower ends of the spout:

the disc, spout and member constituting a single integral unit which when positioned in place on the container will not exhibit any substantial leakage of liquid either when the liquid in the container surges therein because of sudden movement of the container or when the container is disposed horizontally on its side:

the first cap being stacked above the second cap, with the spout of the second cap being extending upwardly into the spout of the first cap.

* * * * *